US010480884B2

(12) United States Patent
Smith

(10) Patent No.: US 10,480,884 B2
(45) Date of Patent: Nov. 19, 2019

(54) ADAPTER ASSEMBLY FOR FIREARM SILENCER

(71) Applicant: RA Brands, L.L.C., Madison, NC (US)

(72) Inventor: Michael Leighton Smith, Alpharetta, GA (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 15/785,820

(22) Filed: Oct. 17, 2017

(65) Prior Publication Data

US 2018/0106569 A1 Apr. 19, 2018

Related U.S. Application Data

(60) Provisional application No. 62/409,219, filed on Oct. 17, 2016.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/325
USPC ..... 89/14.4, 14.05; 181/223; 29/428
See application file for complete search history.

(56) References Cited

U.S. PATENT DOCUMENTS 1,111,202 A 9/1914 Westfall
3,500,955 A 3/1970 Werbell
3,667,570 A 6/1972 Werbell, III
4,510,843 A 4/1985 Rabatin
5,029,512 A 7/1991 Latka
7,412,917 B2 8/2008 Vais
7,516,690 B2 4/2009 McClellan
7,600,606 B2 10/2009 Brittingham
7,610,992 B2 11/2009 Brittingham
7,856,914 B2 12/2010 Shults et al.
7,905,171 B1 * 3/2011 Brittingham ..... F41A 21/30 89/14.4
7,987,944 B1 8/2011 Brittingham et al.
8,096,222 B2 1/2012 Silvers
8,162,100 B2 * 4/2012 Shults ..... F41A 21/30 181/223
8,424,441 B2 4/2013 Brittingham et al.
8,439,155 B2 * 5/2013 Shults ..... F41A 21/30 181/223
8,474,361 B2 7/2013 Brittingham
8,479,632 B2 7/2013 Kline et al.
8,490,535 B1 7/2013 Moore et al.
8,567,556 B2 10/2013 Dueck et al.
8,579,075 B2 11/2013 Brittingham et al.
8,584,794 B2 11/2013 Dueck
8,714,301 B2 5/2014 Shults
8,833,512 B2 9/2014 Smith et al.
8,910,745 B2 12/2014 Latka
8,910,746 B1 12/2014 McKenzie
8,950,310 B2 2/2015 Storrs et al.
8,950,546 B2 * 2/2015 Shults ..... F41A 21/30 181/223
8,973,481 B2 3/2015 Dueck et al.
(Continued)

*Primary Examiner* — Michael D David
(74) *Attorney, Agent, or Firm* — Womble Bond Dickinson (US) LLP

(57) ABSTRACT

An adapter assembly for a silencer may have one or more biasing members that generate a tensile force about the silencer sufficient to substantially arrest movement, loosening or decoupling of one or more components of the silencer.

10 Claims, 12 Drawing Sheets

(56) References Cited

U.S. PATENT DOCUMENTS

| | | | | |
|---|---|---|---|---|
| 8,991,552 | B2 | 3/2015 | Latka | |
| 8,997,621 | B1 | 4/2015 | Dater et al. | |
| 9,038,770 | B1 | 5/2015 | Morrison | |
| 9,038,771 | B1 | 5/2015 | Mueller | |
| 9,091,502 | B1 | 7/2015 | Morrison | |
| 9,097,482 | B1 | 8/2015 | Holden et al. | |
| 9,102,010 | B2 | 8/2015 | Wilson | |
| 9,103,618 | B2 | 8/2015 | Daniel et al. | |
| 9,115,949 | B1 | 8/2015 | Morrison | |
| 9,121,656 | B1 | 9/2015 | McKenzie | |
| 9,207,033 | B2 | 12/2015 | Vais | |
| 9,261,317 | B2 | 2/2016 | Daniel et al. | |
| 9,328,984 | B2 | 5/2016 | Shults et al. | |
| 9,506,710 | B2 | 11/2016 | Smith | |
| 9,631,888 | B2 | 4/2017 | Young | |
| 9,658,019 | B2 * | 5/2017 | Smith | F41A 21/30 |
| 9,746,267 | B2 * | 8/2017 | Smith | F41A 21/30 |
| 2006/0123983 | A1 | 6/2006 | Vais | |
| 2007/0107590 | A1 | 5/2007 | Silvers | |
| 2009/0139795 | A1 | 6/2009 | Brittingham | |
| 2010/0218671 | A1 | 9/2010 | Mayberry et al. | |
| 2011/0056111 | A1 | 3/2011 | Brittingham | |
| 2011/0067950 | A1 * | 3/2011 | Shults | F41A 21/30 181/223 |
| 2011/0220434 | A1 | 9/2011 | Silvers | |
| 2012/0145478 | A1 | 6/2012 | Brittingham | |
| 2012/0199415 | A1 | 8/2012 | Shults et al. | |
| 2012/0279381 | A1 | 11/2012 | Landolt | |
| 2013/0180796 | A1 | 7/2013 | Dueck et al. | |
| 2014/0020976 | A1 | 1/2014 | Shults | |
| 2014/0076658 | A1 | 3/2014 | Smith, II et al. | |
| 2014/0158459 | A1 * | 6/2014 | Shults | F41A 21/30 181/223 |
| 2014/0190345 | A1 | 7/2014 | Daniel et al. | |
| 2014/0224575 | A1 | 8/2014 | Latka | |
| 2014/0231168 | A1 | 8/2014 | Dueck et al. | |
| 2014/0374189 | A1 | 12/2014 | Young et al. | |
| 2015/0226506 | A1 | 8/2015 | Shults et al. | |
| 2015/0260472 | A1 | 9/2015 | Smith | |
| 2015/0260473 | A1 | 9/2015 | Barney | |
| 2015/0267986 | A1 | 9/2015 | Sellars | |
| 2015/0276340 | A1 | 10/2015 | Vais | |
| 2016/0018179 | A1 * | 1/2016 | Morris | F41A 21/30 181/223 |
| 2016/0084602 | A1 | 3/2016 | Smith | |

* cited by examiner

ADAPTER ASSEMBLY FOR FIREARM SILENCER

CROSS-REFERENCE TO RELATED APPLICATIONS

The present Patent Application claims the benefit of U.S. Provisional Patent Application No. 62/409,219 filed Oct. 17, 2016.

INCORPORATION BY REFERENCE

The disclosure of U.S. Provisional Patent Application No. 62/409,219 filed Oct. 17, 2016, is hereby incorporated by reference as if presented herein in its entirety.

TECHNICAL FIELD

This disclosure is directed to, in one aspect, silencers for firearms, and more specifically, to a mounting system including adapter assemblies for securely mounting silencers to substantially fixed or non-moving barrel and/or rifle caliber type firearms.

BACKGROUND

Most silencers designed for use with centerfire pistol-caliber host firearms incorporate into their design parts such as a piston and return coil spring that are collectively called a "Nielsen Device," Linear Inertial Decoupler, or an Assured Semi-Automatic Performance System ("A.S.A.P." System). Such Nielsen Devices enable the weight of the silencer body to move away or decouple from the barrel of the firearm so that the weight of the silencer does not hamper tilting of the breech end of the firearm barrel, which tilting is generally inherent in the modified "Browning" design of most centerfire host pistols found in today's marketplace. The return spring re-positions the silencer body after each shot, to reset the silencer for subsequent shots. However, when using such a silencer on a host firearm with a fixed, non-moving barrel, the movement of the silencer has been seen as unnecessary since the barrel stays substantially static. Thus, to eliminate such unnecessary movement, accessory spacers have been used to replace the return spring of the Nielsen Device so that the silencer may be used on a host firearm with a fixed, non-moving barrel. These spacers typically include pieces of steel or aluminum tube that approximate the length of the spring as it would sit inside the silencer body. A shortcoming of this spacer design that has been found is that when the silencer is of a type configured for use on a tilting barrel host firearm, vibrations from firing can cause the return spring retainer cap to inadvertently unscrew from the body of the silencer during use, which can lead to a decrease in accuracy and reliability of the host firearm.

SUMMARY

Briefly described, in one aspect, the present disclosure is directed to silencer mounting systems for mounting a silencer to a host firearm, including rife-caliber firearms and/or firearms configured with substantially fixed or non-moving barrels. These mounting systems can be used with silencers having generally tubular body with a cavity or chamber defined therethrough, and a rear end cap removably coupled to a proximal end of the tubular body. The silencer also can have a "Nielsen Device," Linear Inertial Recoupler, or an "A.S.A.P." System with a piston and piston return spring so that the weight of the silencer does not hamper movement of the barrel of the host firearm.

The silencer mounting system generally will comprise one or more adapters or adapter assemblies, which can include a spacer having a spacer body with a proximal end and a distal end, and at least one biasing member, such as a wave spring, configured and located to facilitate tensioning of the silencer components so as to substantially retard or prevent inadvertent movement or dislocation of the components of the silencer. The spacer body can have a generally tubular design, with a cavity or chamber defined therethrough that is sized to at least partially receive a shaft portion of a piston of the silencer. The spacer body also may incorporate one or more slots to facilitate the flow of gas therethrough, and further may incorporate one or more internal O-rings that provide a substantially cushioned fit and/or substantially gas-tight seal between an interior surface of the spacer body and the shaft portion of the piston. The wave spring can include a body comprised of ring arcs or segments connected together at a series of locations/points and defining an opening or aperture sized to receive the shaft portion of the piston therethrough. The wave spring further can be positioned along the shaft of the piston between the spacer body and the flange head of the piston in a sandwich-like arrangement.

With the piston having the spacer and wave spring positioned therealong, a distal face or surface of the rear end cap will bear against a proximal face or surface of the spacer body, so that the wave spring is compressed between the distal face or surface of the spacer body and the proximal face of the flange head of the piston. This compression of the wave spring between the proximal surface of a flange head of the piston and the distal surface of the spacer may generate a tension or tensile force between the rear end cap or locking ring and the body of the silencer (i.e., between engaged threads thereof) that is sufficient to substantially prevent inadvertent movement loosening or decoupling/removal of the rear end cap from the silencer, such as due to vibrations experienced during firing of the firearm. Additionally, or in the alternative, one or more wave springs can be positioned along the piston between the rear end cap and the spacer such that the wave spring will be compressed between the distal face or surface of the end cap and the proximal face or surface of the spacer body. The spacer and the wave spring may substantially arrest movement of the piston in relation to the rear end cap or the tubular body of the silencer.

To fit the silencer with the adapter assembly for use with firearms having a fixed or non-moving barrel, the rear end cap or lock ring may be removed (i.e., unscrewed), and the piston and piston return spring slid out of the body of the silencer, after which the piston return spring can then be detached or decoupled from the piston. Thereafter, the spacer and the wave spring can be positioned about the shaft of the piston such that the wave spring is disposed between a distal face or surface of the spacer body and a proximal face or surface of the flange head of the piston in a sandwich-like arrangement, and the silencer body or such that the wave spring is disposed between the distal face or surface of the rear end cap and the proximal face or surface of the spacer body. Tightening of the rear end cap of the silencer against the body thereof compresses the wave spring between the spacer and flange head of the piston so as to create/provide the tensile force between the rear end cap and the body of the silencer sufficient to substantially arrest inadvertent movement or dislocation of the rear end cap from the body of the silencer.

In another aspect, this disclosure is directed to a silencer mounting system in which a series of adapter assemblies can be provided and/or interchanged. Each adapter assembly can have an adapter body with sidewall having a proximal and distal end, with a flange or projection arranged therealong. The flange or projection can have a pair of opposing faces that extend from an exterior surface of the sidewall of the adapter body and terminate in a radial or circumferential surface of the flange or projection. The adapter body also may have slots disposed therealong to facilitate gas flow therethrough, and further may have one or more projections at or adjacent its distal end configured to engage or otherwise cooperate with corresponding projections or notches arranged along an interior surface of the silencer body for substantially arresting rotational movement between the adapter body and the silencer body. In addition, the adapter body further may include a cavity or passage defined therethrough, which cavity or passage may have one or more threads disposed along an interior surface of the adaptor body, and configured to matably engage with corresponding threads of the host firearm for removably attaching the silencer thereto. This cavity or passage can be formed with variable sizes or dimensions, such as with different diameters, to facilitate/allow for connection of the silencer to various firearms or to various sized or dimensioned barrels.

A wave spring can be positioned along the sidewall of the adapter body, and will be configured to create a tension force sufficient to substantially prevent inadvertent movement or dislocation of the silencer components. The wave spring may be positioned substantially adjacent or in contact, or in an abutting relationship, with the proximal face of the flange, so as to be compressed between a surface of the rear end cap, such as a distal face/surface, and the proximal face/surface of the flange, thereby creating the tensile force between the rear end cap and the tubular body of the silencer.

To fit the silencer with the adapter assembly, a selected adapter assembly (i.e., for mounting to a selected size or caliber firearm), with a wave spring received about its adapter body such that at least a portion of the wave spring substantially abuts or contacts the proximal face/surface of the flange, can be at least partially inserted into the silencer body so the adaptor body and wave spring are at least partially received within the interior chamber of the tubular body. The rear end cap of the silencer then will be coupled to or tightened against the proximal end of the silencer body, whereupon the wave spring will be between at least a portion of the rear end cap and the flange of the adapter body. Compression of the wave spring can provide or generate the tensile force between the rear end cap and the tubular body of the silencer with a magnitude sufficient to substantially arrest inadvertent movement or dislocation of the rear end cap from the body of the silencer.

BRIEF DESCRIPTION OF THE DRAWINGS

The accompanying drawings, which are included to provide a further understanding of features of this disclosure, are incorporated in and constitute a part of this specification, illustrate embodiments of this disclosure, and together with the detailed description, serve to explain the principles of this disclosure. No attempt is made to show structural details of the embodiments in more detail than may be necessary for a fundamental understanding of the embodiments and the various ways in which the embodiments may be practiced. In addition, it will be understood by those skilled in the art that the invention and the various features thereof discussed below are explained in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques further may be omitted so as to not unnecessarily obscure the embodiments of this disclosure.

DETAILED DESCRIPTION

Figure 1:
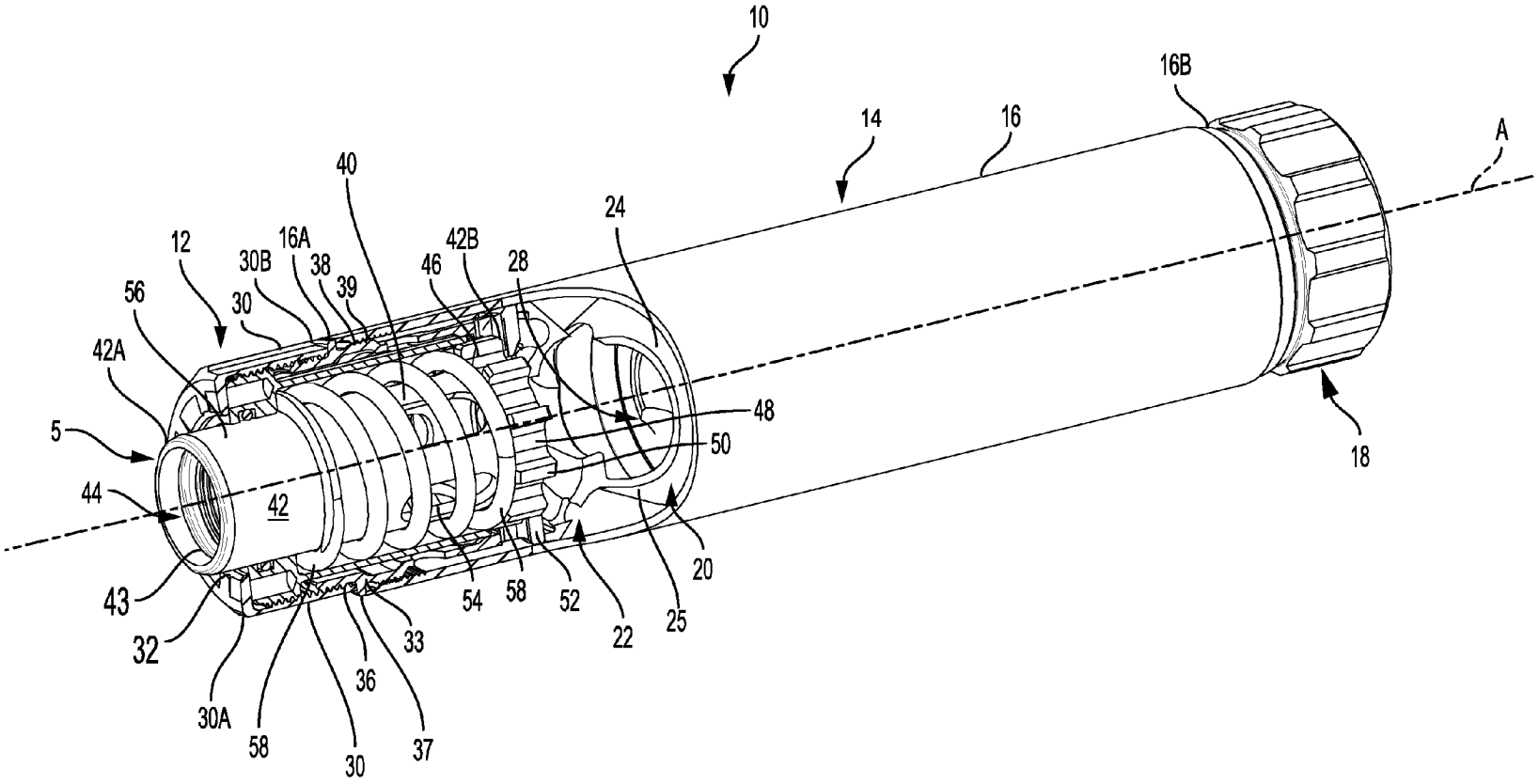
FIG. 1 shows partial cutaway views of silencers with "A.S.A.P." systems including a piston and a return spring.
Figure 2:
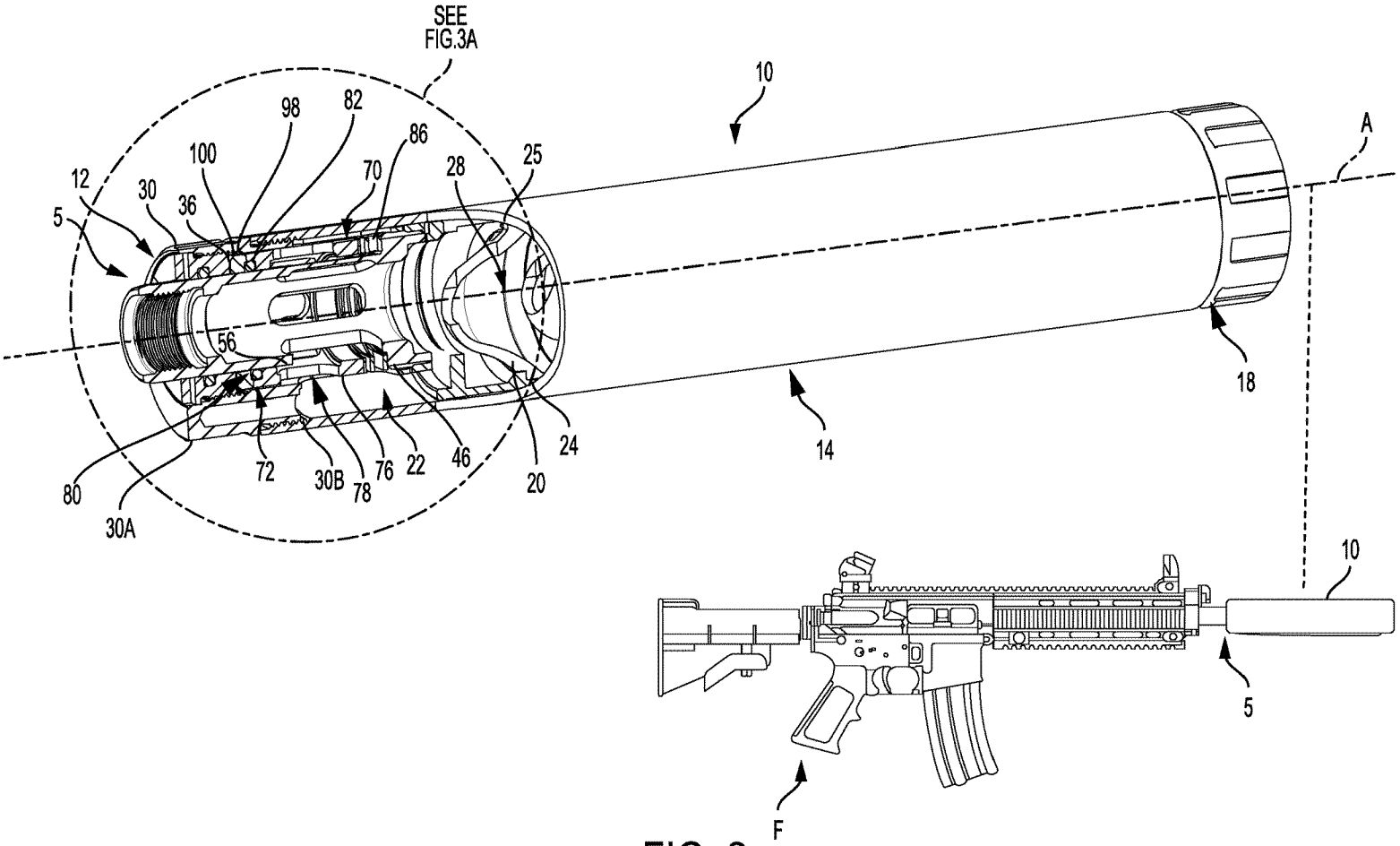
FIG. 2 shows a silencer with a mounting system according to one embodiment of this disclosure.

FIGS. 1-2, 3A, 3B, 4, 5A-5C, 6, 7A and 7B show examples of various configurations of silencers or noise suppressors adapted to be mounted to the muzzle end of a host firearm. As indicated in FIG. 2, the host firearm F generally may include, but not be limited to, rifles and other types of long guns, although various other types of firearms, including pistols or handguns having substantially fixed or non-moving barrel assemblies, also can be used without departing from this disclosure. The silencer mounting system 10 according to the principles of the present disclosure can be configured to generate a tension or tensile force along the silencer having a magnitude sufficient to substantially arrest inadvertent movement, loosening, decoupling, or dislocation of one or more components of the silencer or noise suppressor.

As schematically shown in FIGS. 1-2, 5A, and 5C, a silencer 10 generally can comprise a series of sections, for example including a first, rearward portion or section, such as a lock ring or rear end cap 12, and a second, middle portion or section 14, which may include a tube or tubular portion generally having an elongated body or tube 16, and a third, forward portion or section, such as a front end cap 18. These components may be configured to be easily assembled and/or disassembled, such as for cleaning and/or routine maintenance. These sections 12, 14, and 18 can be substantially cylindrical in shape as shown in the figures; however, these sections also could be formed with alternative body shapes or configurations, such as substantially eccentric, rectangular, oval, or can be otherwise configured without departing from this disclosure. The middle portion 14 of the silencer also generally can include a tubular body or tube 16, or can include a series of modular bodies or tubes connectable together to provide a silencer with a variable configuration or length.

The silencer 10 also includes a baffle core 20 that can be at least partially received within an interior chamber or cavity 22 defined by the body or tube 16 of the middle portion 14. The baffle core 20 can include a body 24 with a series of spaced peripheral portions 26, as generally shown in FIGS. 1-2 and 5A-5C. The body 24 of the baffle core 20 can be a substantially unitary structure, or can include multiple inter-connecting pieces or sections. The body 24 of the baffle core 20 also will have a series of symmetrical or asymmetrical baffles 25 each with an aligned bore or opening 28 defining a passage extending along the longitudinal axis A of the silencer and through which a projectile can pass through upon firing of the host firearm F (FIG. 2). The baffle core 20 also can be removable for replacement and/or for cleaning of residue, debris and/or other materials from the fired projectiles and the combustion gases passing therethrough.

The lock ring or rear end cap 12 of the silencer 10 can include a body 30 with distal and proximal ends 30A/B, and a cavity or passage 32 defined therethrough. The cavity or passage 32 may be substantially aligned with the passage defined by the opening(s) of the baffle core 20 for passage of a fired or discharged projectile through the silencer 10. The rear end cap 12 further may be releasably connected to the tubular body 16 using a threaded adapter socket or coupling 33. For example, the body 30 of the rear end cap 12 may have a mating interface, such as one or more threads 34, disposed along an interior surface 32A of the rear end cap 12, and configured to engage or otherwise interact with a corresponding mating interface, such as one or more threads 35, arranged along an exterior surface 36 of a body 37 of the coupler 33. The coupler 33 additionally may have a mating interface, such as one or more threads 38, arranged along the exterior surface 36 of the coupler body 37 that is configured to matably engage or otherwise interact with a corresponding interface, such as one or more corresponding threads 39, defined along the tubular body 16 of the silencer 10 (e.g., on an interior surface 17 thereof) to removably mate or couple the rear end cap 12 to the tubular body 16, as generally shown in FIG. 1. The rear end cap 12 and tubular body 16 also can be coupled together without the use of coupler 33, for example, by the mating interface 34 arranged along the interior surface 32 of the rear end cap 12 matably engaging or otherwise interacting with a corresponding mating interface, such as one or more threads 39, arranged along an exterior surface 19 of the tubular body 16, as generally shown in FIG. 3A.

The mounting system 5 of the present disclosure further enables the mounting of a silencer 10 that includes a "Nielson" Device, Linear Inertial Decoupler, or an A.S.A.P. system (shown in FIG. 1) which enables the weight of the silencer to float away or decouple from the barrel so that weight of the silencer does not interfere with movement of the barrel to be securely mounted to a substantially fixed or non-moving barrel firearm in a manner so as to substantially retard or arrest unnecessary and unwanted movement of the silencer. For example, the "Nielsen" Device, Linear Inertial/Decoupler, or "A.S.A.P." system can include a piston 40 having a body 42 with a proximal end 42A and a distal end 42B between which a bore 44 defining a projectile passage through which the projectile will pass upon firing, extends, as generally shown in FIG. 1. The proximal end 42A of the piston body 42 may include a connection mechanism, such as a series of threads 43, for connecting the piston 40 and the silencer 10 to the host firearm. The distal end 42B of the piston 42 further can have a piston head or flange 46 including a series of longitudinally extending, radiused cuts 48 that form points or longitudinally extending spokes 50 which protrude outwardly from a portion of the head or flange 46 of the piston 42 (FIG. 1).

Figure 3A:
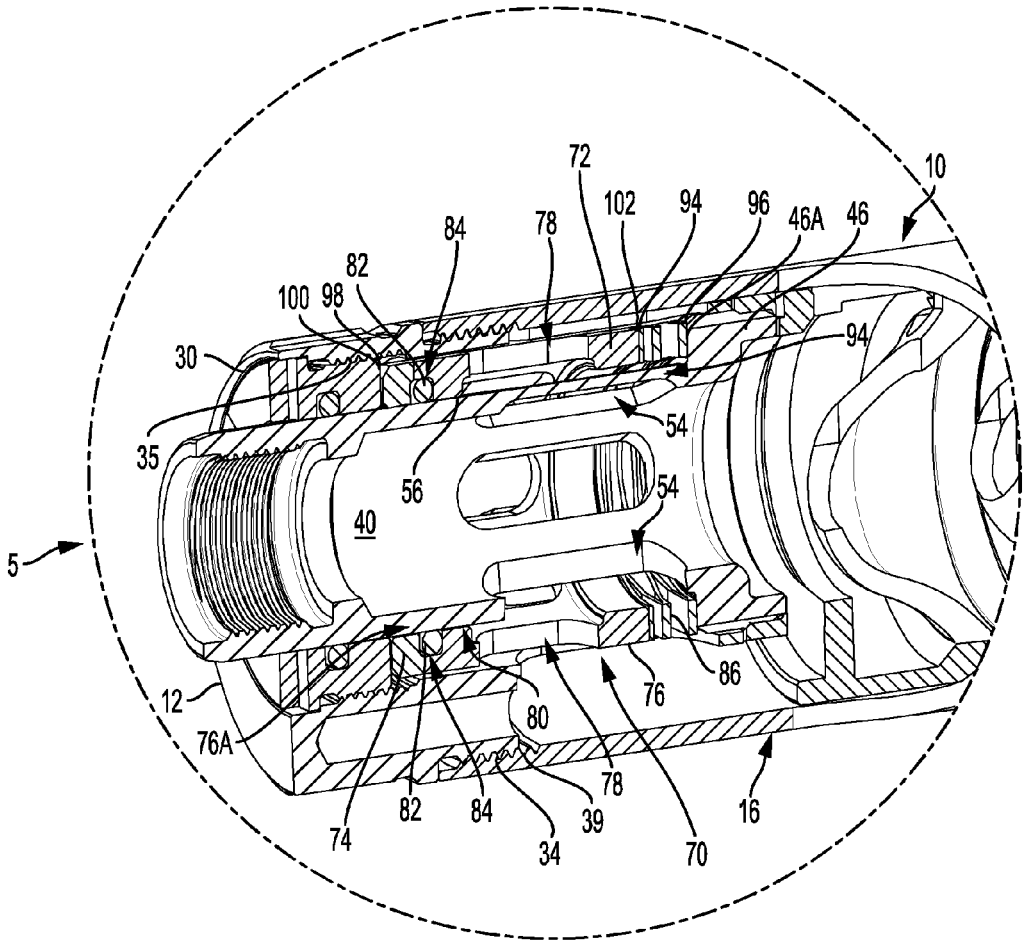
FIG. 3A shows partial cutaway views of a silencer with the mounting system of FIG. 2.
Figure 3B:
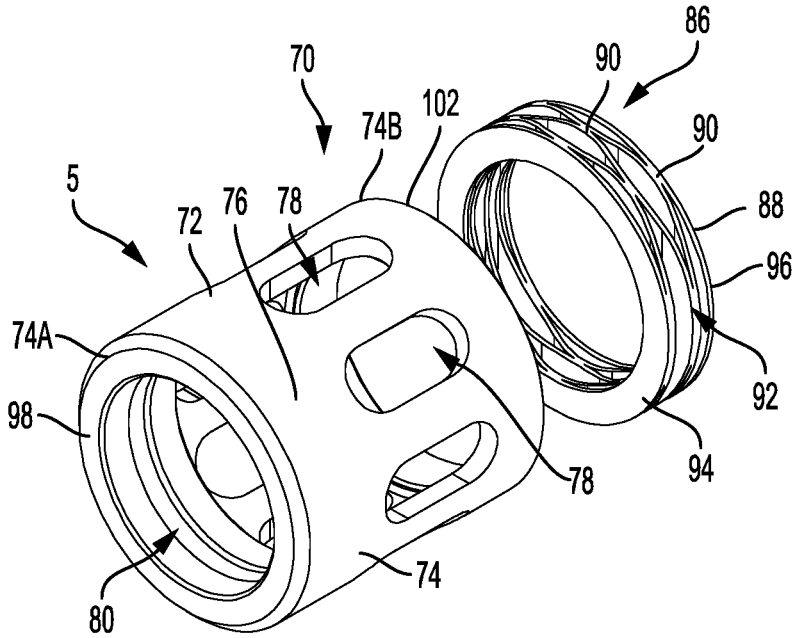
FIG. 3B shows a spacer and a spacer tensioning wave spring of the silencer mounting system of FIG. 2.

According to one aspect of this disclosure, as shown in FIGS. 2 and 3A-3B, the silencer mounting system 5 can include an adapter assembly 70 that can be used to substantially arrest movement or translation of the piston 40 along the tubular body 16 of the silencer 10. In one embodiment, the adapter assembly 70 can include a spacer 72 having a body 74 with a proximal end 74A and a distal end 74B and a substantially cylindrical shape, though the spacer body 74 can have different shapes or configurations without departing from this disclosure. The spacer body 74 can be formed from a durable heat-resistant material such as aluminum, steel, or titanium, though other materials, such as carbon composites, or metals, or other composite materials, are possible without departing from this disclosure. The spacer body 74 further can include a sidewall 76 with a series of holes or vents 78 defined therein, which holes or vents 78 may be positioned about/along the sidewall 76 of the spacer body 74 in a spaced relationship. The spacer body 74 further can include a cavity or passage 80 defined therethrough that is sized or dimensioned to at least partially receive the shaft 56 of the piston 30. The holes or vents 78 may be sized, dimensioned or configured to at least partially align or overlap with the holes or vents 54 of the piston shaft 56 to provide an escape path for the expanding gases resulting from firing of the firearm. FIGS. 3A and 3B show that the spacer body 74 can have one or more O-rings 82 positioned along the interior cavity 80. For example, one or more notches or recesses 84 may be defined within an interior surface 76A of the sidewall 76 of the spacer body 74 within the cavity or passage 80, and these notches 84 can at least partially receive an O-ring 82, such as an O-ring formed from rubber or other suitable material, to provide a substantially gas-tight seal and/or a substantially cushioned fit between the spacer body 74 and the shaft 56 of the piston such that, e.g., the O-ring may substantially dampen vibrations between the spacer and the piston (FIGS. 3A and 3B).

The adapter assembly 70 further will include one or more wave springs 86 as shown in FIGS. 2-3B. As generally illustrated in FIG. 3B, the construction of the wave spring(s) 86 utilized with the present disclosure generally can include a series of substantially flattened rings or segments 88 having a non-uniform, irregular body configuration or construction 92, as opposed to being substantially round, uniform sections of a drawn wire such as found with conventional coiled springs. The use of such flattened or wave springs generally can provide greater strength and deflection with a reduced spring size and a more compact arrangement. Alternatively, each of the individual segments or rings 88 can be formed separately and attached via weld lines or other attachments at joints 90 to form a composite wave spring body 92. The wave spring body 92 further will define a cavity or passage 94 therein, which will be configured/sized to receive a shaft 56 of a piston 40 therethrough. Each of the spring segments 88 also can be formed with varying strengths of compression and deflection properties so that the resultant spring can vary in compression strength and deflection from a top portion to its bottom portion or from a forward position to a rear position. The spring segments 88 further can be clipped, bound, bonded or otherwise attached to each other, or can be hooked or otherwise interlocked together to form the resultant spring structure. As a result, the wave spring 86 can be formed/selected with varying levels of compression strength or deflection properties to provide greater control of the deflection or compression of the spring and increasing support as the spring is compressed under increasing weight.

As still a further alternative embodiment, the flattened configuration and size of the wave springs 86 also can allow for a series of wave springs to be stacked to form a composite spring, and/or for additional, similar biasing elements, such as Bellville washers, locking washers, curved disks, wave disk finger disks, elastomers, such as O-rings, etc., to also be used. Any suitable biasing elements, mechanisms, devices, or materials, such as those with a reduced or minimal size or configuration that provides an increased biasing force relative thereto may be employed without departing from this disclosure. For example, a series of springs of substantially varying compressive strength can be built, each having different degrees of compressive strength and deflection properties, enabling easy adjustments and/or repairs or replacements of such springs as needed. Accordingly, with the spring construction of the present disclosure, smaller, less bulky springs be utilized, while still providing greater biasing strength and deflection so as to create or provide a tensioning force between the mated engaging surfaces of the rear end cap 12 and body 16 of the silencer 10 or a sufficient magnitude to substantially arrest and resist unwanted and unnecessary movement of the silencer body upon being subjected to vibration from firing.

As further shown in FIGS. 2 and 3A, one or more wave springs 86 can be received or positioned along the shaft 56 of the piston 40 between the spacer 72 and the head 46 of the piston 40. With the rear end cap 12 coupled to the proximal end of the tubular body 16, the proximal face or shoulder 98 of the spacer 72 can be engaged by, abut against, or in face-to-face contact with an distal, interior surface or shoulder 100 of the rear end cap 12, with the wave spring 86 compressed in a sandwich-type arrangement between a distal face or shoulder 102 of the spacer 72 and the proximal face or shoulder 46A of the piston flange head 46 (FIG. 3A). As a result, the proximal face or shoulder 94 of the wave spring 86 will be in abutting or face-to-face contact with the distal face 102 of the spacer 72, and the distal face or shoulder 96 of the waves spring 86 will be in abutting or face-to-face contact with the shoulder 46A of the piston flange head 46 (FIG. 3A). Tightening of the rear end cap 12 against the tubular body 16 thus can compress or deform the wave spring 86 between the spacer 72 and flange head 46 of the piston 40, so as to in turn create/generate a tensile or tension force between the engaging/mating surfaces rear end cap 12 and the tubular body 16 of the silencer 10 (e.g., the engaged threaded coupling therebetween). In addition, or alternatively, one or more wave springs can be positioned between the spacer and the rear end cap or proximal end of the piston such that the wave spring(s) are compressed between the distal surface or shoulder the rear end cap and the proximal face or shoulder of the head of the piston (not shown). The wave spring 86 can be configured or selected such that this tension force is sufficient to substantially arrest inadvertent movement, loosening, or decoupling or removal of the rear end cap 12 from the tubular body 16 of the silencer 10. The adapter assembly 70 with the spacer 72 and wave spring 86 may also substantially arrest movement of the piston 40 in relation to the rear end cap 12 or tubular body 16.

To couple or attach the adapter assembly 70 to the silencer 10 for use with a firearm having a fixed or non-moving barrel, the rear end cap 12 may be removed, and the piston 40 and piston return spring 58 disposed thereabout may be moved or slid out of the tubular body 16 of the silencer 10, such as through the opening 23 in its proximal end 16A. The piston return spring 58 can then be detached or decoupled from the piston 40. Thereafter, the spacer 72 and the wave spring 86 can be positioned about the shaft 56 of the piston 40 such that the wave spring 86 is disposed between the distal face or shoulder 102 of the spacer body 74 and a proximal face or shoulder 46A of the flange head 46 of the piston 40 in a sandwich-like arrangement. The piston 40, with the spacer 72 and wave spring 86 disposed thereon, can be inserted into the opening 23 at the proximal end 16A of the tubular body 16, and the rear end cap 12 can be coupled to or tightened against the tubular body 16 of the silencer 10 to secure the piston 40 therein. Tightening of the rear end cap 12 against the tubular body 16 may compress or deform the wave spring 86 between the spacer 72 and flange head 46 of the piston 40 so as to generate a tensile force between the rear end cap 12 and the tubular body 16 of the silencer 10 that is sufficient to substantially arrest inadvertent movement, loosening, or removal of the rear end cap 12 from the tubular body 16 of the silencer 10.

The present disclosure, however, is not limited to this specific construction/arrangement of the spacer and wave spring(s). For example, in one alternative, the spacer 72 can be removed and a plurality of wave springs or other biasing mechanisms can be positioned along the piston 40 in an end-to-end series, such that these wave springs are compressed between the rear end cap 12 and flange head 46 of the piston 40. In another alternative example, one or more coil springs with a stiffness sufficient to substantially arrest movement of the piston 40 with respect to the silencer tube 16 or rear-end cap 12, while also providing a sufficient tension between the cap 12 and tube 16 so to substantially prevent loosening or decoupling the silencer components, can be used. The stiffness of such a coil spring may be selected such that the coil spring experiences substantially minimal, or approximately zero, displacement under the loading forces exerted on the piston due to firing of the firearm. Such a spring may include, or have a construction similar to, a "die" spring, and can comprise a substantially flat wound wire.

Figure 4:
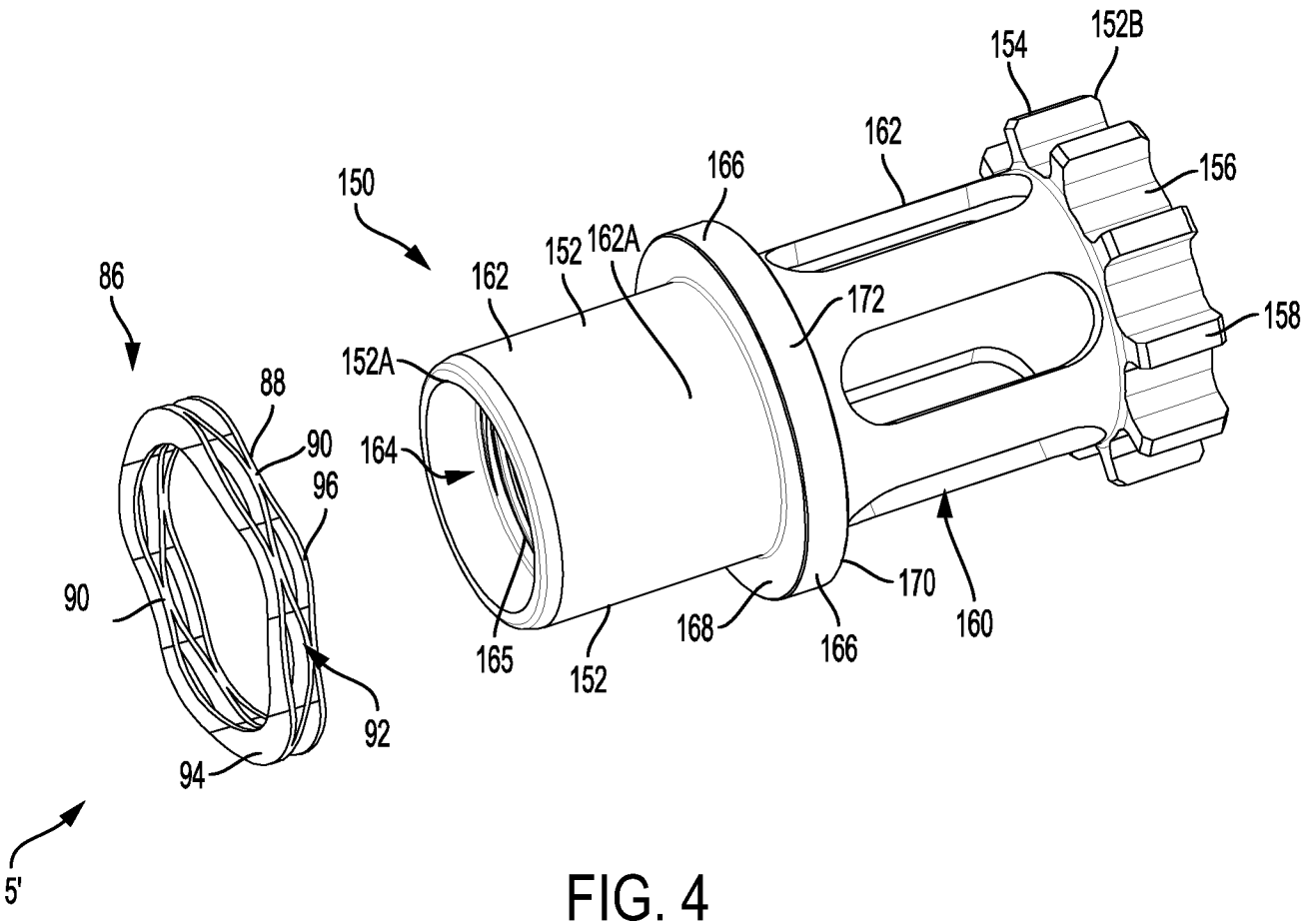
FIG. 4 shows a perspective, exploded view of an adapter assembly and including an adapter body with a flange and a biasing member according to principles of this disclosure.

In another embodiment of this disclosure, shown in FIG. 4, the silencer mounting system 5' can comprise an adapter assembly 150 that may include an adapter body 152 sized and shaped to substantially match that of the piston 40. For example, the adapter body 152 can have a generally cylindrical shape with proximal and distal ends 152A/B, though other shapes are possible without departing from this disclosure. The adapter body 150 can be formed from aluminum, steel, titanium, or other suitable materials. The adapter body 152 further can have a head 154 with a series of notches or recesses 156 defined therein to form a series of spaced spokes 158 at the distal end 152B of the adapter body 152. The spokes 158 of head 154 interact with corresponding notches/projections 52 of the tubular body 16 so as to define cooperative locking elements between the adapter body 152 and tubular body 16, whereby the engagement between these spokes 158 and notches/projections 52 can substantially rotationally lock together the adaptor body 152 and the tubular body 16 so as to substantially prevent relative rotation therebetween when the adaptor body 152 is at least partially received in the tubular body 16. A series of holes or vents 160 may further be defined in a sidewall 162 of the adapter body 152 to provide an escape path for the expanding gases resulting from firing. A passage way 164 further may include one or more threads 165 for removably coupling the adapter body 152 and thereby the silencer 10 to corresponding threads of a host firearm F. This passage 164 or threads 165 may be formed with a selected size, dimension or configuration to facilitate connection or mounting of the silencer 10 to a prescribed caliber or size firearm. As shown in FIG. 4, the adapter body 152 further may include a projection or flange 166 arranged along the sidewall 162 of the adapter body 152, projecting radially outwardly and defining opposite facing proximal and distal surfaces or shoulders 168 and 170 that extend between the exterior surface 162A of the sidewall 162 and a radial or circumferential surface 172 of the flange 166.

The adapter assembly 150 also may include at least one wave spring 86 positioned along the sidewall 162 of the adapter body 152 as shown in FIGS. 4 and 5A-5D. The wave spring 86 may be positioned adjacent to or in an abutting relationship with the flange 166, with a distal face 96 of the wave spring 86 is in substantially abutting contact with the proximal face or shoulder 168 of the flange 166, such that the wave spring 86 will be positioned between the interior face or shoulder 100 of the end cap 16 and the proximal face or shoulder 168 of the flange 166 in a sandwich-like arrangement. Thereafter, tightening of the rear end cap 12 against the tubular body 16 of the silencer will compress or deform the wave spring 86 between rear end cap 12 and the flange 166 of the adaptor body 152 so as to generate a tensile or tension force between the rear end cap 12 and the tubular body 16 of the silencer 10 that is of a magnitude sufficient to substantially arrest inadvertent movement, loosening, or dislocation of the rear end cap 12 from the tubular body 16 of the silencer 10.

To attach the adapter assembly 150 to the silencer 10 for use with firearms having a fixed or non-moving barrel, the rear end cap 12 may be removed from the proximal end 16A of the tubular body 16 of the silencer 10, and the piston 40 and piston return spring 58 disposed thereabout may be moved or slid out from the chamber 22 of the tubular body 16 of the silencer 10, such as through the opening 23 in its proximal end 16A. The wave spring 86 can be placed onto the adapter body 152 such the distal face or shoulder 96 of the wave spring 86 substantially abuts or contacts the proximal face or shoulder 168 of the flange 166. The adaptor assembly 150 then can be at least partially inserted into the opening 23 at the proximal end 16A of the tubular body 16 so the adaptor body 152 and wave spring 86 are at least partially received within the interior chamber 22 of the tubular body 16. With the adaptor assembly 150 at least partially received within the interior chamber 22 of the tubular body 16, the rear end cap 12 can be coupled to or tightened against the proximal end 16A of the tubular body 16 to secure the adaptor assembly 150 therein. This tightening of the rear end cap 12 against the tubular body 16 may compress or deform the wave spring 86 between the rear end cap 12 and the flange 166 of the adapter body 152. This compression of the wave spring 86 thereby can provide or generate a tensile force between the rear end cap 12 and the tubular body 16 of the silencer 10 that has a magnitude sufficient to substantially arrest inadvertent movement, loosening, removal or decoupling of the rear end cap 12 from the tubular body 16 of the silencer 10.

Figure 5A:
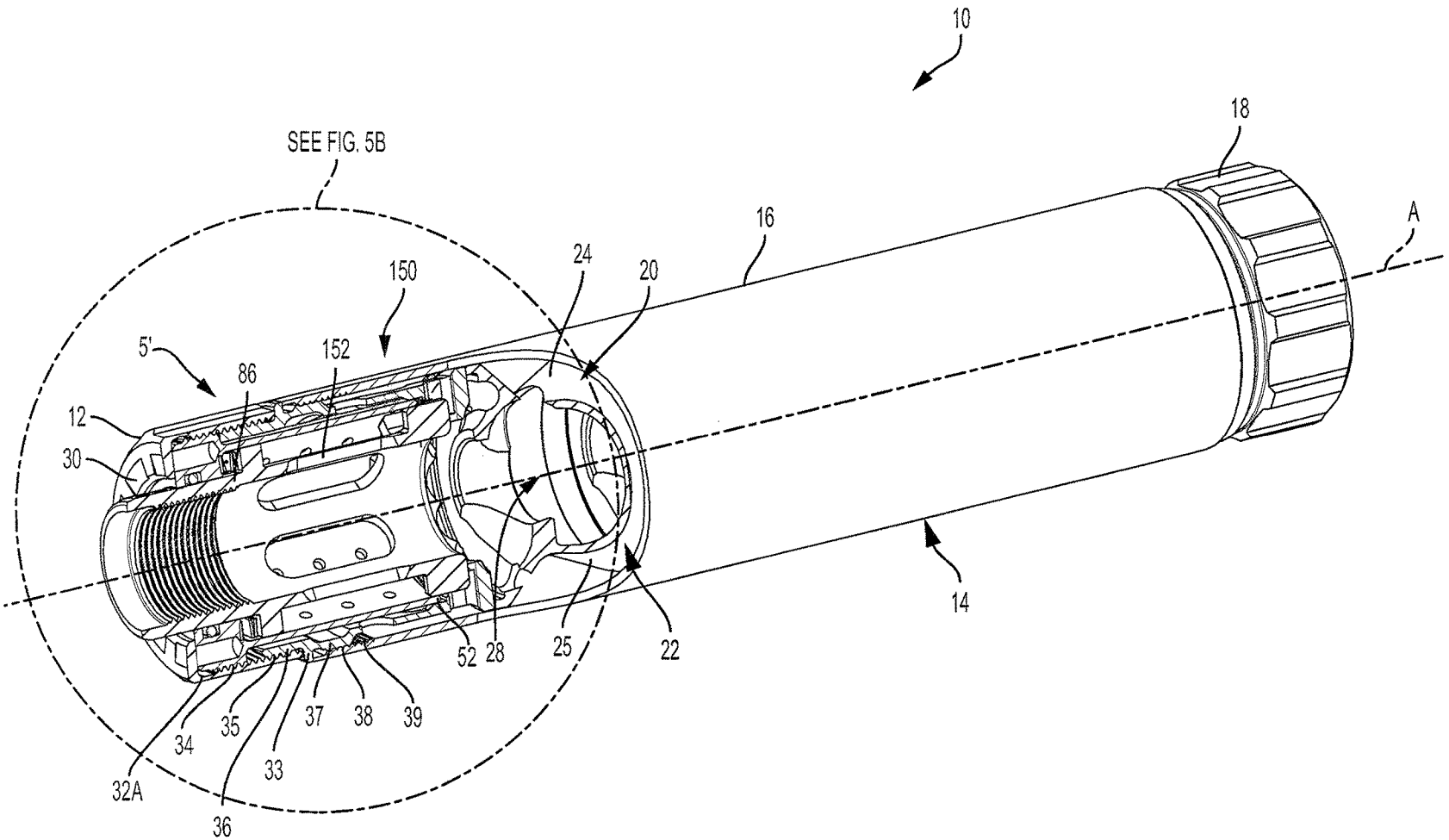
FIGS. 5A-5D show partial cutaway and cross-sectional views of a silencer with the threaded adapter and spring of FIG. 4.
Figure 5B:
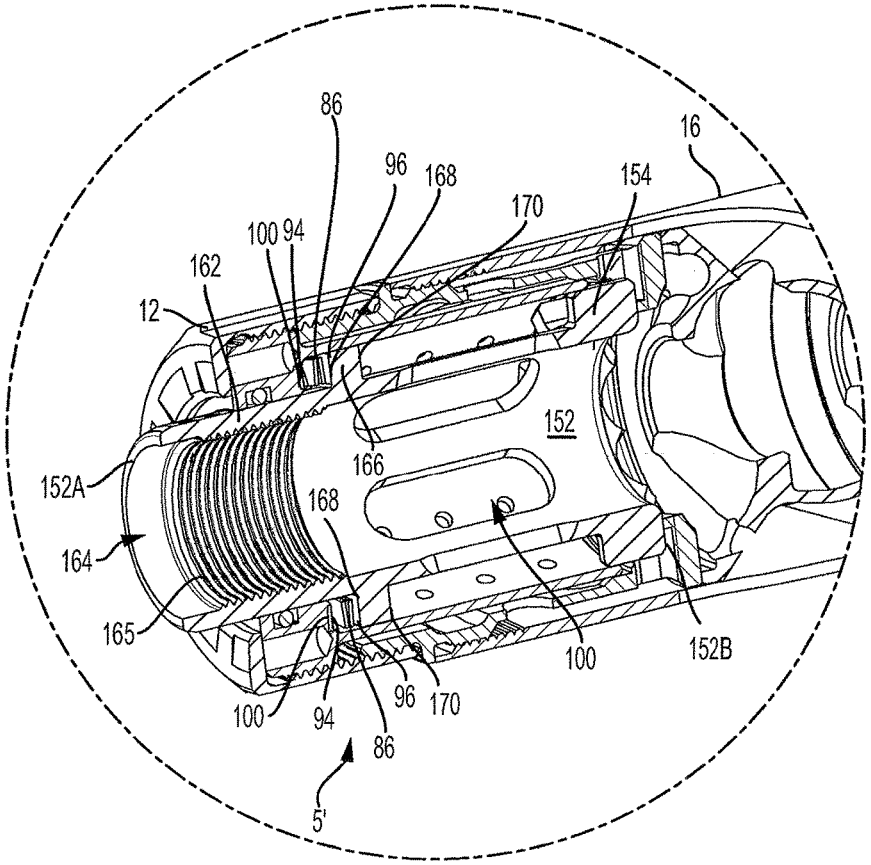
Figure 5C:
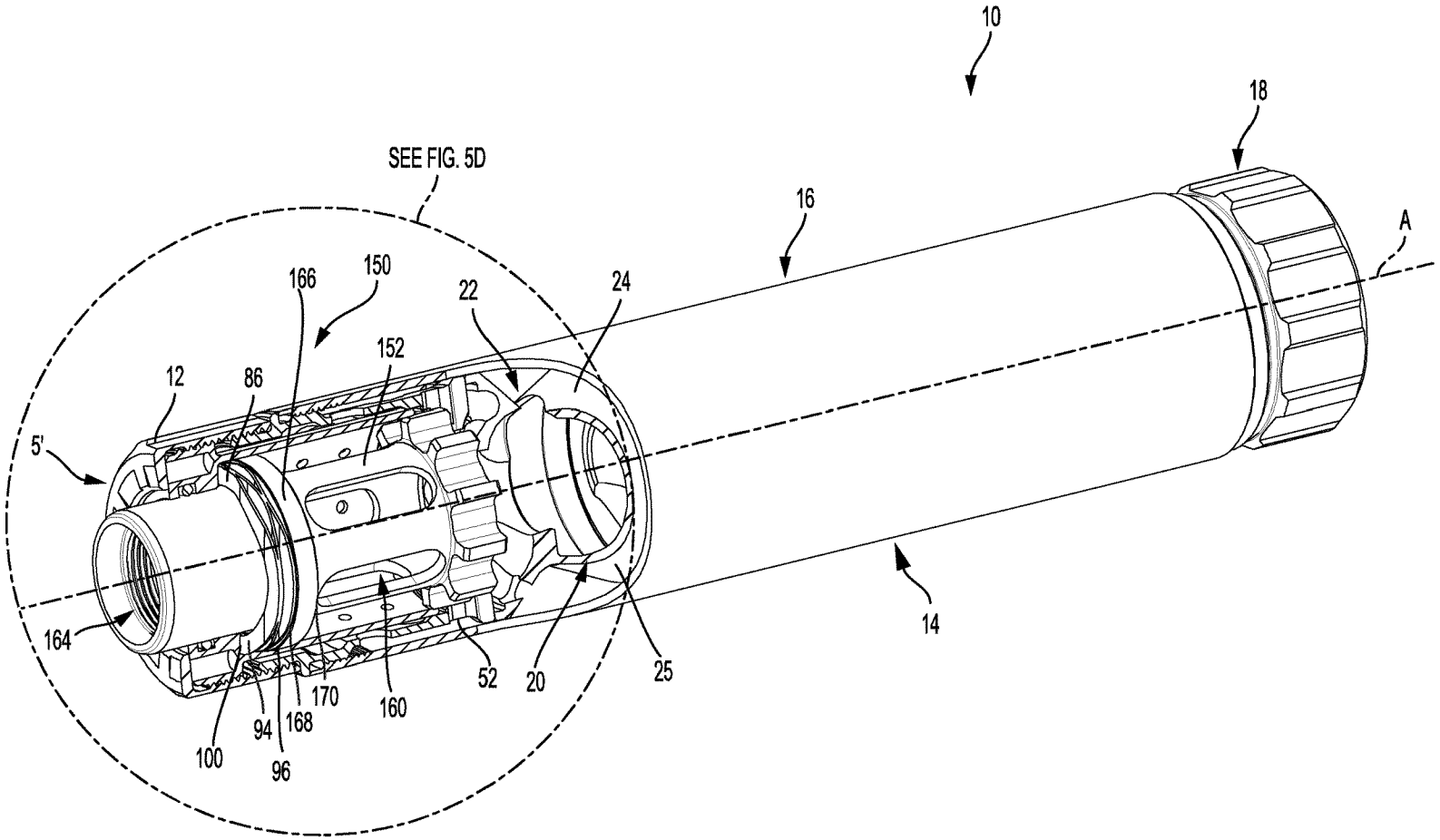
Figure 5D:
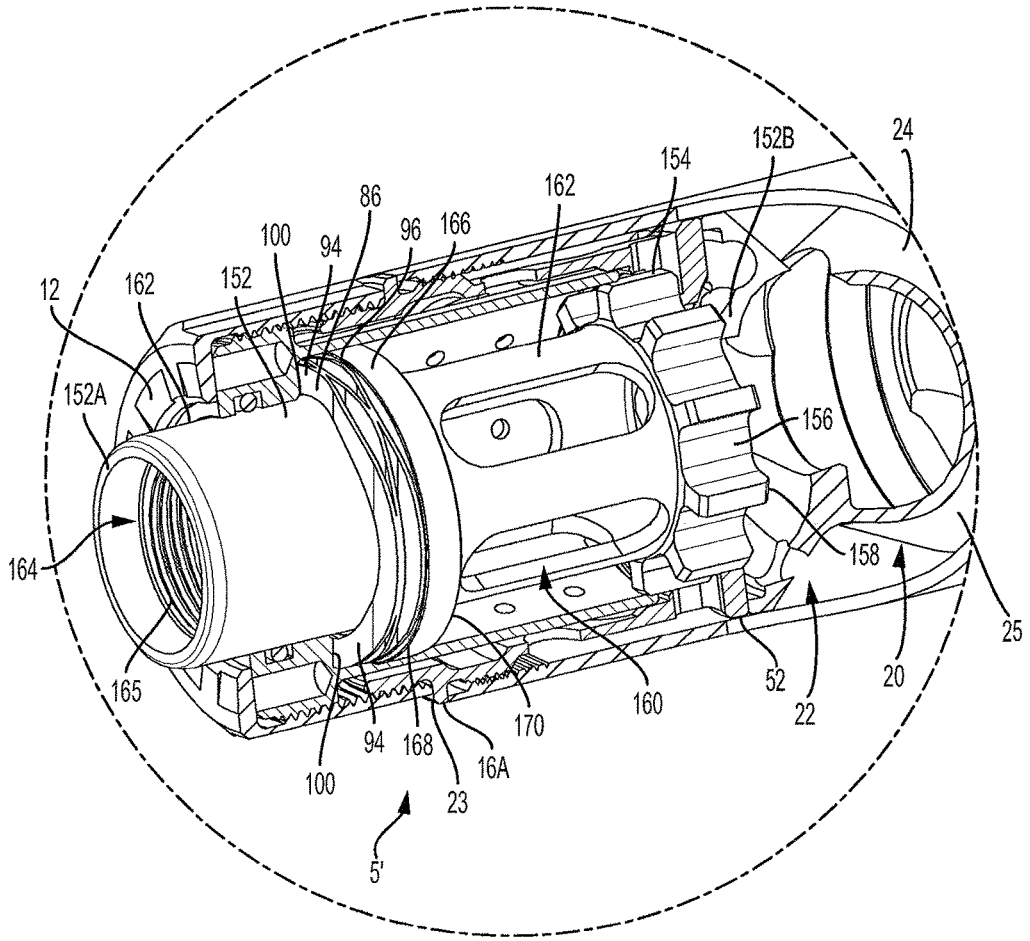
Figure 6:
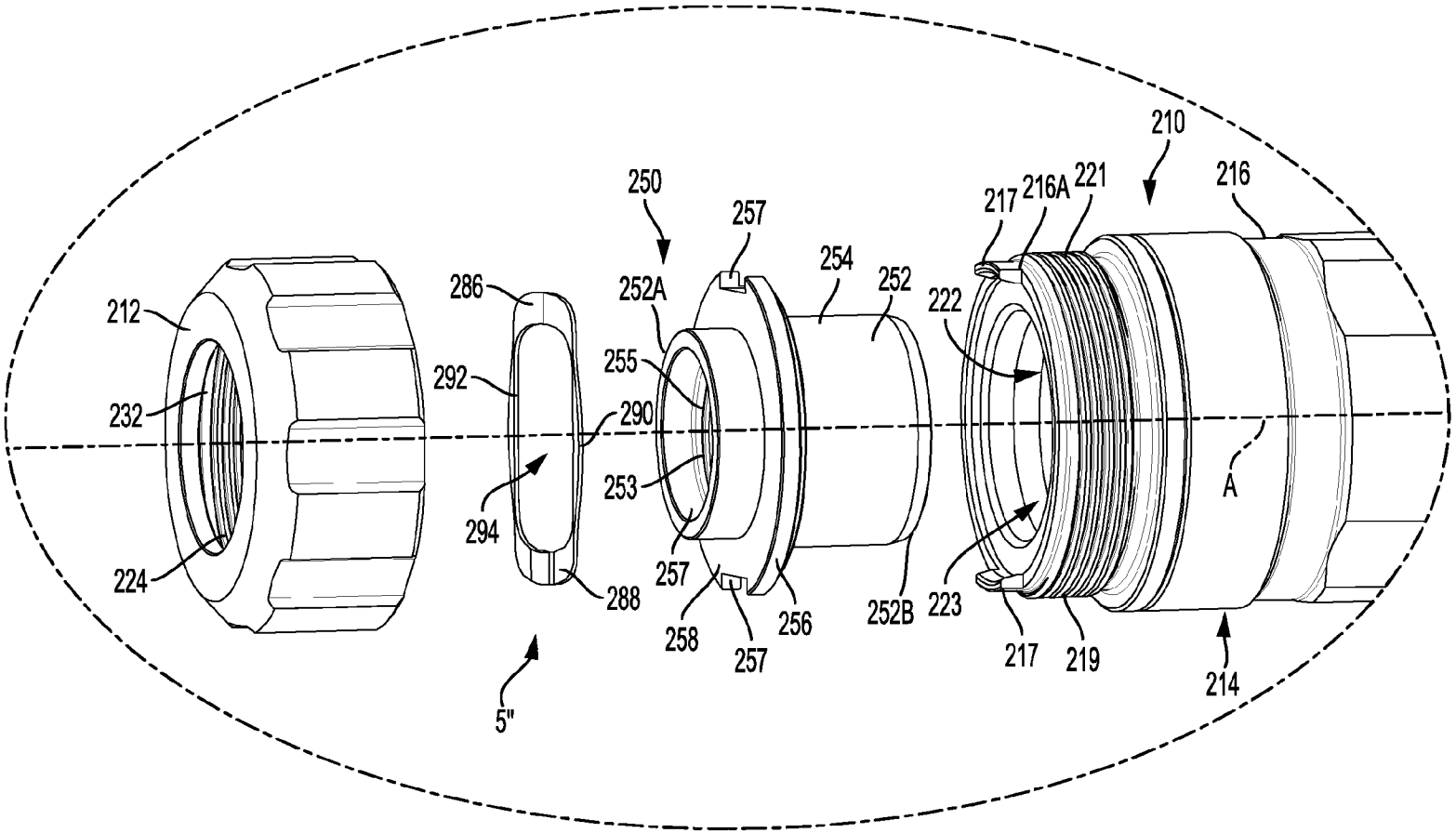
FIG. 6 shows an adapter and wave spring according to principles of this disclosure.
Figure 7A:
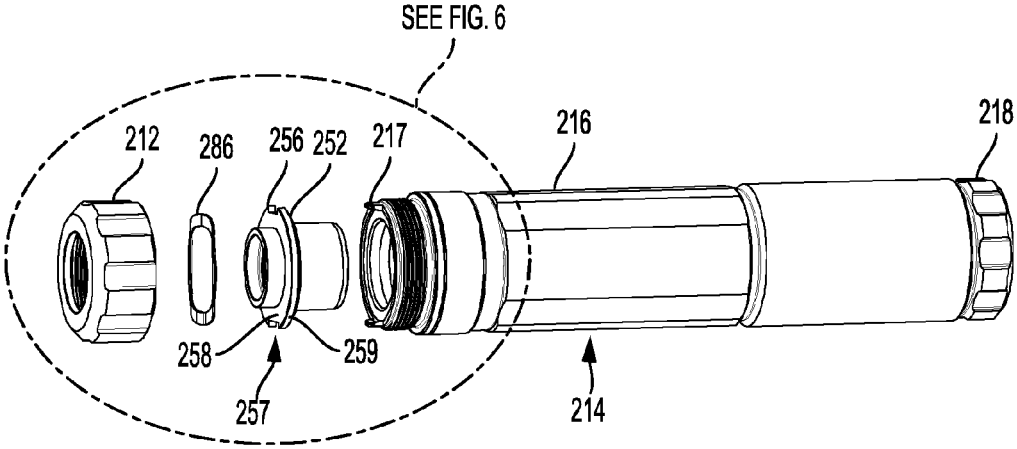
FIGS. 7A-7C show partial cutaway and cross-sectional views of a silencer with the adapter and wave spring of FIG. 6.
Figure 7B:
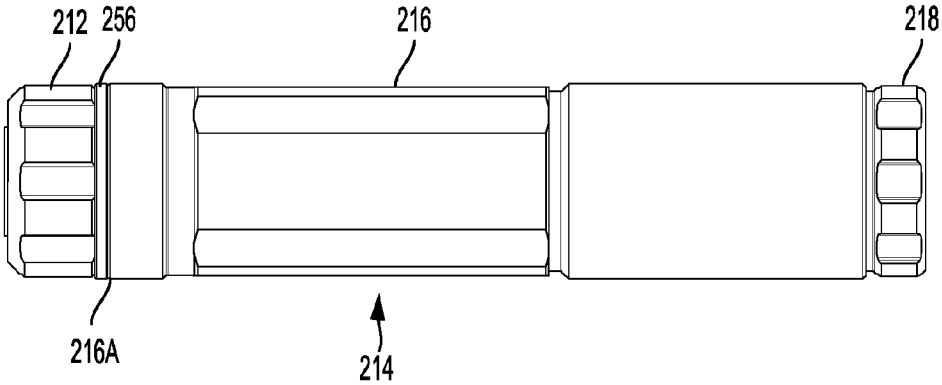
Figure 7C:
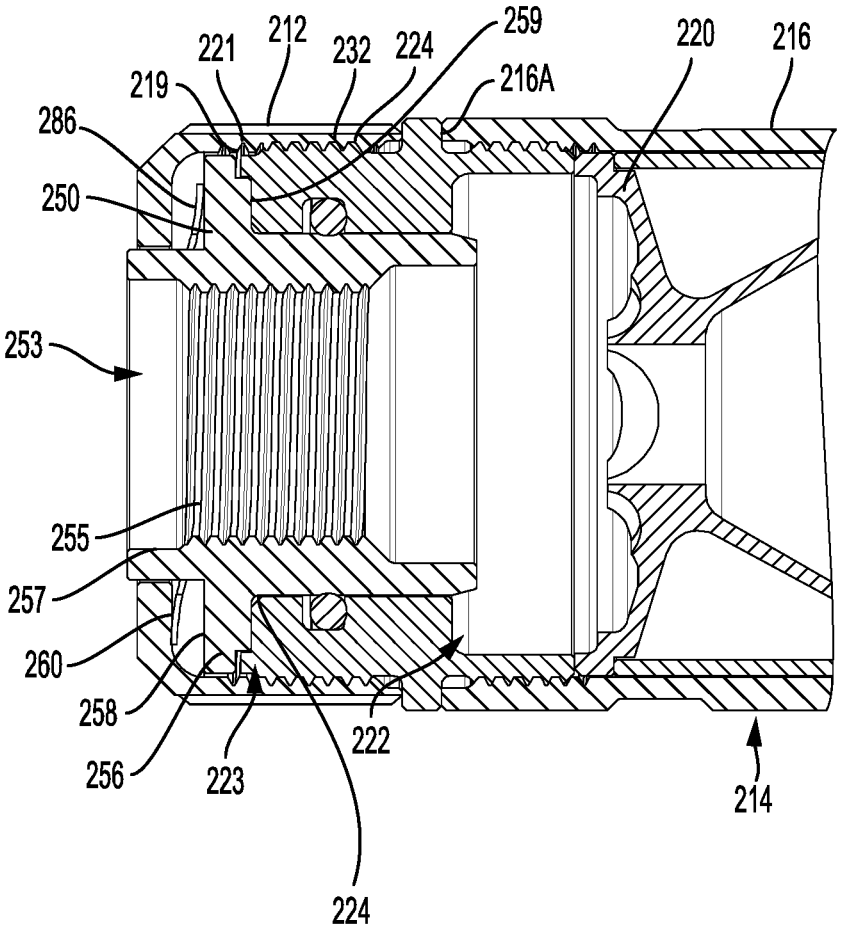

A further alternative embodiment of the silencer mounting system 5" is as shown in FIGS. 6 and 7A-7C for use with a silencer 210 that can have a similar construction to that of the silencer 10 of FIGS. 2, 5A and 5B. For example, as shown in FIGS. 6 and 7A-7C, the silencer 210 generally can comprise a series of sections, including a first, rearward portion or section, such as a lock ring or rear end cap 212, and a second, middle portion or section 214, which may include one or more tube or tubular portions generally having an elongated body or tube 216, and a third, forward portion or section, such as a front end cap 218. The silencer 210 also can include a baffle core 220 at least partially received within an interior chamber or cavity 222 defined by the body or tube 216 of the middle portion, as generally shown in FIG. 7C, and which baffle core 220 can be a substantially unitary structure, or can include multiple interconnecting pieces or sections. The rear end cap 212 of the silencer 210 also can include a mating interface, such as threads 224, arranged along an interior surface 232 of the rear end cap 212 that can be configured to matably engage or otherwise interact with a corresponding mating interface, such as one or more threads 221, arranged along an exterior surface 219 of the tubular body 16 (FIGS. 6 and 7C).

An adapter assembly 250 including a wave spring 286 will be provided to substantially arrest or prevent inadvertent movement, loosening or dislocation of the components of the silencer 210. The adapter assembly 250 also can facilitate coupling of the silencer 210 to various different caliber and/or type firearms, such as firearms with barrels having various diameters. For example, as illustrated in FIGS. 6 and 7A-7C, the adapter assembly 250 can include an adapter body 252 or a series of interchangeable adapter bodies, with proximal 252A and distal ends 252B and a sidewall 254 having and a flange or projection 256 disposed or positioned thereabout. The series of adapter bodies may be configured to facilitate connection of the silencer 210 to various caliber or size firearms. The adapter body (or bodies) 252 can be formed from aluminum, steel, titanium, or other suitable materials. The flange 256 may have opposing facing shoulders or surfaces 258 and 259, and the flange 256 further may have a series of notches or recesses 257 defined therein, which notches or recesses 257 can be sized and positioned to align with and at least partially receive one or more corresponding protrusions 217 arranged along the proximal end 216A of the tubular body 216 of the silencer 210. Engagement of the notches 257 and the corresponding protrusions 217 may substantially arrest rotational movement of the adaptor body 250 in relation to the tubular body 216 of the silencer 210. The adapter body 252 further may include a cavity or passage 253 defined therethrough, which cavity or passage 253 may have one or more threads 255 disposed along an interior surface 257 of the adaptor body 252, and configured to matably engage with corresponding threads of the host firearm for removably attaching the silencer thereto. This cavity or passage 253 or threads 255 can be formed with variable sizes, dimensions, or configurations to facilitate connection of the silencer 210 to various firearms or to various sized or dimensioned barrels. For example, the cavity or passage 253 may have a diameter selected from a range between approximately 0.3 inches to approximately 1.0 inches.

FIG. 6 further shows that the adapter assembly 250 may comprise a wave spring 286 (or series of wave springs) having a body 288 comprised of rings or segments, or stacked series of rings or bodies 290 connected together at locations/points 292 and that defines an opening or aperture 294 sized to fit about the sidewall 254 of the adaptor body 252 (FIG. 6). The wave spring(s) 286 can be positioned about the adapter body 252 substantially adjacent to, in abutment, or contact, with a proximal face or surface 258 of the flange 256. With the adapter assembly 250 positioned within the tubular body 216 of the silencer 210, the wave spring 286 can be positioned between the an interior face or shoulder 260 of the end cap 216 and the proximal face or shoulder 258 of the flange 256 in a sandwich-like arrangement. Thus, tightening of the rear end cap 212 against the tubular body 216 may compress or deform the wave spring 286 between rear end cap 212 and the flange 256 of the adaptor body 252 so as to generate a tensile force between the rear end cap 212 and the tubular body 216 of the silencer 210 that is sufficient to substantially arrest inadvertent movement, loosening, or removal of the rear end cap 12 from the tubular body 16 of the silencer 10.

In use of the present embodiment of the silencer mounting system 5", the rear end cap 212 of the silencer will be removed from the body 216 of the silencer 210. An adapter body will be selected for the size, type or caliber barrel of the firearm, and a wave spring 286 placed onto the adapter body 252 such that at least a portion of the wave spring 286 substantially abuts or contacts the proximal face/surface 258 of the flange 256. The adapter assembly 250 can be positioned in relation to the tubular portion 216 such the notches or recesses 257 of the flange substantially align with the one or more projections 217 on the proximal end 216A of the tubular body 216. The adaptor assembly 250 then can be at least partially inserted into the opening 223 at the proximal end 216A of the tubular body 216 so the adaptor body 252 is at least partially received within the interior chamber 222 of the tubular body 216, and the one or more protrusions 217 at the proximal end 216A of the tubular body 216A are at least partially received within the corresponding notches 257 of the adapter flange. The distal face of the shoulder 259 of the flange can abut against the proximal end 216A of the body 216 or an attachment thereto, such as a coupler or a threaded socket adapter attached to the body 216. With the adaptor assembly 252 at least partially received within the interior chamber 222 of the tubular body 216, the rear end cap 212 can be coupled to or tightened against the proximal end 216A of the tubular body 216 to secure the adaptor assembly 252 therein. Tightening of the rear end cap 212 against the tubular body 216 may compress or deform the wave spring 286 between at least a portion of the rear end cap 212 and the flange 256 of the adapter body. This compression of the wave spring 286 can provide or generate a tensile force between the rear end cap 212 and the tubular body 216 of the piston that has a magnitude sufficient to substantially arrest inadvertent movement, loosening or removal of the rear end cap 212 from the tubular body 216 of the silencer 210.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A silencer, comprising:

an elongated silencer body having a distal end, a proximal end, and a projectile passage defined therethrough;

a baffle core at least partially received within and extending along the projectile passage defined through the silencer body, the baffle core comprising a core body including a series of spaced baffles, with a passage extending through each of the baffles and substantially aligned with the projectile passage of the silencer body to allow a projectile fired from a firearm to pass therethrough;

a piston positioned within the silencer body and comprising a piston body having a proximal end, a distal end, and a piston bore defined therethrough, the piston bore being substantially aligned with the passage of the baffle core; and an adapter assembly including a passage configured to at least partially receive the piston body therein to arrest movement of the piston body along the silencer body, and at least one biasing member engaged against the piston body to generate a force along the baffle core and/or the piston within the silencer body sufficient to prevent inadvertent dislocation or movement of one or more components of the silencer.

2. The silencer of claim 1, wherein the adapter assembly comprises a spacer having a spacer body with a proximal end, a distal end, and a cavity defined therethrough that is configured to receive at least a portion of the piston body.

3. The silencer of claim 2, wherein the spacer body comprises one or more vents defined therein to facilitate release of gases generated from firing of the firearm.

4. The silencer of claim 2, wherein the spacer body is at least partially formed from aluminum, steel, titanium, carbon composites, or combinations thereof.

5. The silencer of claim 2, further comprising a plurality of O-rings positioned along an interior surface of the spacer body, and at least partially engaging the piston body to provide a substantially gas-tight seal and/or a substantially cushioned fit between the spacer body and the piston body.

6. The silencer of claim 1, wherein the silencer body further comprises a first portion along which the piston is located, and a second portion mounted to the first portion and along which the baffle core extends.

7. The silencer of claim 1, wherein the at least one biasing member comprises at least one wave spring having a plurality of flattened segments each with a non-uniform, irregular body.

8. The silencer of claim 1, wherein the at least one biasing member comprises one or more wave springs, Bellville washers, locking washers, curved disks, wake finger disks, elastomers, or combinations thereof.

9. The silencer according to claim 1, wherein the piston comprises a series of threads disposed therealong substantially adjacent its distal end that are configured to cooperatively engage with one or more threads of the firearm.

10. The silencer according to claim 1, wherein the baffle core comprises a substantially unitary structure or multiple interconnecting sections.

* * * * *